US005281306A

United States Patent [19]

Kakiuchi et al.

[11] Patent Number: 5,281,306

[45] Date of Patent: Jan. 25, 1994

[54] WATER-DISINTEGRABLE CLEANING SHEET

[75] Inventors: Shusuke Kakiuchi; Makoto Ishii, both of Tochigi; Atsuo Nakae, Saitama; Seiko Ikoma, Tochigi, all of Japan

[73] Assignee: Kao Corporation, Tokyo, Japan

[21] Appl. No.: 863,487

[22] Filed: Apr. 2, 1992

Related U.S. Application Data

[63] Continuation of Ser. No. 443,172, Nov. 30, 1989, abandoned.

[30] Foreign Application Priority Data

| | | | |
|---|---|---|---|
| Nov. 30, 1988 | [JP] | Japan | 63-303159 |
| Nov. 30, 1988 | [JP] | Japan | 63-303160 |
| Feb. 28, 1989 | [JP] | Japan | 1-47534 |

[51] Int. Cl.[5] ..... D21H 21/14

[52] U.S. Cl. ..... 162/158; 162/168.1; 162/175; 162/177; 162/178; 162/181.2

[58] Field of Search ..... 162/146, 157.6, 177, 162/135, 158, 179, 178, 181.2

[56] References Cited

U.S. PATENT DOCUMENTS

| | | | |
|---|---|---|---|
| 3,692,725 | 9/1972 | Duchane | 260/29.6 |
| 4,164,595 | 8/1979 | Adams et al. | 162/135 |
| 4,294,873 | 10/1981 | Hartmann et al. | 427/391 |
| 4,904,524 | 2/1990 | Yoh | 162/135 |

FOREIGN PATENT DOCUMENTS

| | | | |
|---|---|---|---|
| 0013969 | 8/1980 | European Pat. Off. . | |
| 0112654 | 7/1984 | European Pat. Off. . | |
| 2042781 | 4/1971 | Fed. Rep. of Germany | 162/177 |
| 61-296159 | 12/1986 | Japan . | |
| 1371096 | 10/1974 | United Kingdom | 162/177 |
| 1510667 | 5/1978 | United Kingdom | 162/146 |

*Primary Examiner*—Peter Chin

*Attorney, Agent, or Firm*—Birch, Stewart, Kolasch & Birch

[57] ABSTRACT

A water-disintegrable cleaning sheet comprising a web of water-dispersible fibers having incorporated thereinto a water-soluble binder having a carboxyl group; at least one metallic ion selected from the group consisting of ions of alkaline earth metals, manganese, zinc, cobalt, and nickel; and an aqueous cleaning agent containing an organic solvent, is disclosed. The sheet satisfies both water disintegrability and strength even when cotained a cleaning agent of high water content.

13 Claims, No Drawings

WATER-DISINTEGRABLE CLEANING SHEET

This application is a continuation of application Ser. No. 07/443,172 filed on Nov. 30, 1989, now abandoned.

FIELD OF THE INVENTION

This invention relates to a water-disintegratable cleaning sheet, and more particularly to a water-disintegratable cleaning sheet comprising a specific water disintegratable, paper having incorporated or impregnated thereinto an aqueous cleaning agent containing an organic solvent, which is suitable for cleaning or sterilization of floors or walls of rooms or toilet rooms, furniture, toilet seats, toilet basins, etc. or useful as toilet paper, and can be thrown into flushing water.

BACKGROUND OF THE INVENTION

Water-disintegratable papers or cleaning goods made of a chemical-containing water-disintegratable paper which can be thrown into water have been used as toilet paper or for cleaning a toilet room or toilet equipment. Conventional water-disintegratable paper usually contains a dry strength agent such as polyvinyl alcohol, carboxymethyl cellulose, and cationic starch, for enhancing dry paper strength without impairing water disintegrability.

However, a paper sheet containing a dry strength agent undergoes serious reduction of strength when impregnated with water. Therefore, where a water-disintegratable paper is combined with a cleaning agent for cleaning or sterilization of floors, walls, furniture, and toilet equipment or for use as toilet paper, the cleaning agent to be combined therewith has been limited to liquid substances or chemicals having no or very low water content.

In using a cleaning agent of high water content, it has been necessary that the cleaning agent should be foamed and sprayed on a water-disintegratable paper immediately before use and be used without delay in order to suppress water absorption into paper and to prevent strength reduction.

Polyacrylamide or the like, as a dry strength agent endows paper with strength enough to withstand use even with a small amount of water being impregnated in the paper sheet, but tends to impair water disintegratability of the sheet.

Hence, the conventional dry strength agents could not provide a strength enough to withstand cleaning use even when combined with a cleaning agent of high water content in good balance with water disintegratability.

It has been proposed to spray a binder solution containing polyvinyl alcohol and borax on a paper sheet followed by drying by heat whereby polyvinyl alcohol and borax are reacted to provide water-disintegratable paper having temporary water resistance, which is useful as absorbent materials such as napkin or diaper, as disclosed in JP-A-47-9486 (the term "JP-A" as used herein means an "unexamined published Japanese patent application"). Further, JP-A-61-296159 discloses a water-disintegratable paper in which an aqueous solution containing salts such as potassium salt, calcium salt and barium salt, is impregnated into a fibrous sheet containing carrageenan as a binder, which is used for a wetting tissue paper. Furthermore, JP-A-55-103393 discloses a method for preparing a paper having high strength in a dry state while low in wet state, which comprises treating paper surface with alkali metal and/or alkali earth metal salt of polyacrylic acid polymers, and that the paper can be used for writing paper, printing paper, wrapping paper, etc. These water-disintegratable papers, however, do not withstand the mechanical force in cleaning work when impregnated with water.

SUMMARY OF THE INVENTION

An object of the present invention is to provide a water-disintegratable cleaning sheet containing a cleaning agent, which has strength enough for cleaning use under a mechanical force while retaining satisfactory water disintegratability.

As a result of extensive investigations, the inventors have found that the above object of the present invention is accomplished by incorporating a water-soluble binder having a carboxyl group and at least one metallic ion selected from the group consisting of ions of an alkaline earth metal, manganese, zinc, cobalt and nickel, and an aqueous cleaning agent containing an organic solvent into a web composed of water-dispersible fibers.

The present invention provides a water-disintegratable cleaning sheet comprising a web of water-dispersible fibers having incorporated thereinto a water-soluble binder having a carboxyl group; at least one polyvalent metallic ion selected from the group consisting of ions of alkaline earth metals, manganese, zinc, cobalt and nickel; and an aqueous cleaning agent containing an organic solvent.

DETAILED DESCRIPTION OF THE INVENTION

Water-dispersible fibers which constitute a water-disintegratable cleaning sheet of the present invention are not particularly restricted as long as they are fibrous materials substantially dispersible in water. Examples of suitable water-dispersible fibers are wood pulp fibers, non-wood vegetable fibers, and synthetic fibers such as rayon fibers and polyester fibers.

Water-soluble binders having a carboxyl group which can be used in the present invention include polysaccharide derivatives, synthetic high polymers, and naturally-occurring substances.

Examples of suitable polysaccharide derivatives include carboxymethyl cellulose, carboxyethyl cellulose, and carboxymethylated starch, with carboxymethyl cellulose being preferred.

Examples of suitable synthetic high polymers include homopolymers of an unsaturated carboxylic acid, copolymers of two or more unsaturated carboxylic acids, and copolymers of an unsaturated carboxylic acid and other copolymerizable monomer. Specific examples of suitable unsaturated carboxylic acids are acrylic acid, methacrylic acid, itaconic acid, crotonic acid, maleic anhydride, maleic acid, and fumaric acid. Monomers copolymerizable with the unsaturated carboxylic acid include esters of these unsaturated carboxylic acids, vinyl acetate, olefins (e.g., ethylene), acrylamide, and vinyl ether. Preferred of these high polymers are those containing an acrylic acid and/or methacrylic acid unit, e.g., polyacrylic acid, polymethacrylic acid, an acrylic acid-methacrylic acid copolymer, and an acrylic acid (or methacrylic acid)-alkyl acrylate (or alkyl methacrylate) copolymer.

Examples of suitable naturally-occurring water-soluble binders are alginic acid, xanthan gum, arabic gum, tragacanth gum, and pectin.

Among these water-soluble binders, carboxymethyl cellulose is particularly preferred.

The water-soluble binder is usually used in an amount of from 0.1 to 30% by weight, preferably from 1 to 15% by weight, and more preferably form 1 to 10% by weight, based on an amount of a dry web.

The metallic ion which is incorporated into the water-disintegratable cleaning sheet of the present invention (hereinafter referred to as an "essential metallic ion") is at least one member selected from the group consisting of ions of alkaline earth metals such as magnesium, calcium, strontium and barium; manganese; zinc; cobalt; and nickel.

Of the metallic ions as described above, calcium, strontium, barium, zinc, cobalt, and nickel ions are preferred from the standpoint of sufficient strength for cleaning work of the cleaning sheet of the present invention.

Monovalent metallic ions other than those described above satisfy water disintegratability but cannot afford strength withstanding cleaning work. Divalent metallic ions other than those described above, e.g., $Cu^{2+}$, $Fe^{2+}$ or $Sn^{2+}$, and trivalent metallic ions other than those described above, e.g., $Fe^{3+}$ or $Al^{3+}$, afford strength enough for cleaning work but do not satisfy water disintegrability.

The essential metallic ion is preferably used in an amount of at least ¼ mol, more preferably at least ½ mol, per mol of carboxyl group of the water-soluble binder.

The essential metallic ion is incorporated into the water-disintegratable cleaning sheet of the present invention in the forms:

(A) an intermolecular mixed salt of the water-soluble binder formed between the carboxyl group thereof and (a) an alkali metal and (b) at least one selected from the group consisting of alkaline earth metals, manganese, zinc, cobalt and nickel; and/or (B) at least one of water-soluble salts such as hydroxides, chlorides, sulfates, nitrates, carbonates, formates and acetates, of at least one member selected from the group consisting of an alkaline earth metal, manganese, zinc, cobalt and nickel.

In the intermolecular mixed salt as mentioned above as form (A), a molar ratio of (a)/(b) is in the range of from 1/0.01 to 1/10, preferably from 1/0.05 to ⅓.

When the metal ion is incorporated into the cleaning sheet of the present invention in the form (B) above, an alkali metal salt of the binder which formed a salt between the carboxyl group and an alkali metal such as sodium and potassium, is preferably used as a water-soluble binder.

The above forms (A) and (B) of the essential metallic ion are used each alone, or combination thereof to incorporate the essential metallic ion into the cleaning sheet of the present invention.

The water-disintegratable cleaning sheet of the present invention can be produced by incorporating water-disintegratable paper composed of the above-mentioned components with an aqueous cleaning agent containing an organic solvent.

Processes for producing the water-disintegratable paper which constitute the water-disintegratable cleaning sheet of the present invention are not particularly restricted and include conventionally known wet process and dry process. For example, when the essential metallic ion is incorporated in the water-disintegratable paper in the form (B) above, the water-disintegratable paper can be obtained by spraying or coating an aqueous solution of the water-soluble salt of at least one selected from the group consisting of alkaline earth metals, manganese, zinc, cobalt and nickel, to a dry web containing carboxyl-containing water-soluble binder, and then drying. The paper containing carboxyl-containing water-soluble binder is obtained by adding a carboxyl-containing water-soluble binder into an aqueous dispersion of water-dispersible fibers and then subjecting paper making, or by spraying or coating a carboxyl-containing water-soluble binder to a web composed of water-dispersible fibers, and then drying. Further, it can be obtained by spraying or coating a carboxyl-containing water-soluble binder and an aqueous solution containing water-soluble salt of at least one selected from the group consisting of an alkaline earth metal, manganese, zinc, cobalt and nickel, and then drying.

When the essential metallic ion is incorporated in the water-disintegratable paper in the form (A) above, namely a form of an intermolecular mixed salt of the water-soluble binder, the water-disintegratable paper is obtained by adding the intermolecular mixed salt binder into ah aqueous dispersion of water-dispersible fibers and then subjecting paper making, or by spraying or coating a solution of the intermolecular mixed salt binder to a web composed of water-dispersible fibers and then drying.

Further, when the essential metallic ion is incorporated in the water-disintegratable paper in combination of forms (A) and (B) above, the above-mentioned incorporating processes are optionally combined to obtain the paper.

Processes for producing the water-disintegratable cleaning sheet of the present invention are not particularly restricted, and it can be produced, for example, by incorporating or impregnating an aqueous cleaning agent into the water-disintegratable paper as described above, or adding an aqueous cleaning agent into the water-disintegratable paper at any step of the above-mentioned production procedure of the water-disintegratable paper. Further, the water-disintegratable cleaning sheet can be produced by incorporating an aqueous cleaning agent together with the essential metallic ion of the present invention. In such production, the essential metallic ion is, for example, incorporated into the water-disintegratable cleaning sheet by dissolving at least one of water-soluble salt of the essential metallic ion, namely the form (B) as mentioned above, into an aqueous cleaning agent containing an organic solvent, and impregnating or spraying the resulting aqueous cleaning agent into the web containing calboxyl-containing water-soluble binder, and then drying.

The aqueous cleaning agent which is incorporated in the cleaning sheet essentially contains an organic solvent for obtaining high strength withstanding cleaning work. Suitable organic solvents are water-compatible (or water-soluble) solvents typically including monohydric lower alcohols such as ethanol, methanol, and propanol; glycols such as ethylene glycol, diethylene glycol, polyethylene glycol, propylene glycol, dipropylene glycol, butylene glycol and hexylene glycol; mono- or diethers of the aforementioned glycols and lower alcohols such as methanol, ethanol and butanol; esters of the aforementioned glycols and lower fatty acids; and polyhydric alcohols such as glycerine and sorbitol. In using water-insoluble solvents, they are added in the form cf an emulsion.

The aqueous cleaning agent is usually used in an amount about 0.5 to 5 times, preferably 1 to 2.5 times the weight of water-disintegratable paper.

The content of the organic solvent in the aqueous cleaning agent ranges from 95 to 5% by weight, preferably from 8 to 92% by weight, and that of water ranges from 5 to 95% by weight, preferably from 92 to 8% by weight. For sterilization of toilet equipment, etc., cleaning agents rich in organic solvent, e.g., ethanol and isopropyl alcohol, are employed. For removal of hydrophilic dirt from living rooms, kitchens or toilet rooms, aqueous cleaning agents rich in water are employed. In this case, the water content ranges from 30 to 95% by weight, preferably from 40 to 92% by weight, more preferably from 60 to 90% by weight, and the organic solvent content ranges from 5 to 70% by weight, preferably from 8 to 60% by weight, more preferably from 10 to 40% by weight.

If desired, the aqueous cleaning agents may further contain surfactants, sterilizers, deodorizers, perfumes, and the like.

As the surfactants which may be contained in the cleaning agent of the present invention, anionic surfactants, nonionic surfactants, cationic surfactants and amphoteric surfactants are include. Preferred examples thereof include amine oxides having one or two of alkyl group containing 8 to 22 carbon atoms or lower alkyl group, sulfobetaines or hydroxysulfobetaines having alkyl group containing 8 to 22 carbon atoms, and carbobetaines having alkyl group containing 8 to 22 carbon atoms, as amphoteric surfactants; alkylsulfates containing 8 to 22 carbon atoms, alkyl ether sulfates adding 1 to 30 mol of ethylene oxide and having alkyl group containing 8 to 22 carbon atoms, alkylbenzene sulfonic acid salts having alkyl group containing 8 to 22 carbon atoms, α-sulfofatty acid ester salts containing 8 to 22 carbon atoms, alkyl (or alkenyl) succinates containing 6 to 22 carbon atoms, and paraffinsulfonates containing 8 to 22 carbon atoms, as anionic surfactants; polyoxyalkylenes (mainly, polyoxyethylene, polyoxypropylene, or a mixture of these), glycol ethers, polyoxyalkylene alkyl phenyl ethers, alkyl glycosides, and sucrose fatty acid esters, as nonionic surfactants; quaternary ammonium salts having an alkyl group containing 8 to 14 carbon atoms, as cationic surfactants. These surfactants are added into the cleaning agents to be incorporate into water-disintegratable cleaning sheet in an amount of generally from 0.1 to 5% by weight.

A cleaning sheet prepared by simply impregnating water-disintegratable paper containing a carboxyl-containing water-soluble binder with an aqueous solution having dissolved therein the above-described metallic ion, or by simply incorporating the web composed of water-dispersible fibers with an intermolecular mixed salt of the water-soluble binder fails to exhibit sufficient strength enough to carry out cleaning. It is considered that a combined use of an organic solvent markedly accelerates formation of an insolubilized crosslinked complex of the water-soluble binder and the metallic ion to thereby afford sufficient strength for cleaning work even in using an aqueous cleaning agent having a very high water content. Further, when spent water-disintegratable paper is discarded into toilet flushing water, etc., the metallic ion and organic solvent in the sheet are diluted with a large quantity of water to make the insolubilized binder water-soluble, thereby maintaining water disintegrability.

As described above, the water-disintegratable cleaning sheet of the present invention, even when using a cleaning agent of high water content, exhibits strength withstanding cleaning work and satisfactory water disintegrability in good balance and produces great effects as cleaning sheet.

The present invention is now illustrated in greater detail by way of the following Examples, but it should be understood that the present invention is not construed as being limited thereto. All the percents, parts, and ratios are given on a weight basis unless otherwise indicated.

EXAMPLE 1

A toilet paper-like water-disintegratable paper sheet having a basis weight of 25 g/m$^2$ was produced from a bleached kraft pulp of conifer beaten to a CSF (Canadian Standard Freeness) of 680 cc using an ordinary paper machine.

The water-disintegratable paper sheet was sprayed with 3% (corresponding to 0.75 g/m$^2$) of a sodium carboxymethyl cellulose "CMC 2200" (produced by Daisel Kagaku K.K.) in the form of a 1% aqueous solution and dried to obtain a CMC-containing sheet.

The CMC-containing sheet was impregnated with 1.7 times the sheet weight of a 1% solution of calcium chloride in an ethanol/water mixed solvent having a ratio of 50/50, 20/80, 10/90 or 0/100 to obtain a water-disintegratable cleaning sheet.

Wet tensile strength, dusting and fuzzing on use, and water disintegrability of the resulting cleaning sheet were evaluated in accordance with the following test methods. The results obtained are shown in Table 1 below.

1. Wet Tensile Strength:

A strip 25 mm wide and 100 mm long was cut out of the cleaning sheet, and breaking strength of the strip in the machine direction (MD) and cross direction (CD) was measured using a universal testing machine "RTM-25" (manufactured by Orientic K.K.) under conditions of 300 mm/min in rate of pulling and 50 mm in grip distance.

2. Dusting and Fuzzinc:

The cleaning sheet was used for wiping black tiles inclusive of the joints for 5 minutes. Dusting on the tiles and fuzzing of the sheet were observed and evaluated according to the following rating system.

○: Neither substantial dusting nor fuzzing was observed.

Δ: Slight dusting was observed, but fuzzing was not observed.

×: Dusting and fuzzing were observed.

3. Water Disintegrability:

In 1 l-volume beker was put 500 ml of water and agitated with a stirrer at 300 rpm.

The cleaning sheet was cut to pieces of 50 mm ×50 mm and put into the water under stirring. After 90 seconds, the disintegrated and dispersed state of the sheet was observed and evaluated according to the following rating system, taking commercially available toilet paper as a standard having satisfactory dispersibility.

○: Satisfactory dispersion

Δ: Slightly poor dispersion

×: Poor dispersion

COMPARATIVE EXAMPLE 1

A cleaning sheet was produced in the same manner as in Example 1, except for using an impregnating solution containing no calcium chloride. The resulting cleaning sheet was evaluated in the same manner as in Example 1, and the results obtained are shown in Table 1 below.

TABLE 1

| | Ethanol/Water (w/w) | | | | | | | |
|---|---|---|---|---|---|---|---|---|
| | 50/50 | | 20/80 | | 10/90 | | 0/100 | |
| Example 1 | | | | | | | | |
| Wet Tensile Strength (g/25 mm) | MD 1020 | CD 620 | MD 480 | CD 310 | MD 370 | CD 220 | MD 40 | CD 28 |
| Dusting and Fuzzing | o | | o | | o | | x | |
| Water-Disintegrability | o | | o | | o | | o | |
| Comparative Example 1 | | | | | | | | |
| Wet tensile Strength (g/25 mm) | MD 350 | CD 200 | MD 90 | CD 50 | MD 35 | CD 20 | MD 30 | CD 17 |
| Dusting and Fuzzing | Δ | | x | | x | | x | |
| Water-Disintegrability | o | | o | | o | | o | |

EXAMPLE 2

Each of calcium chloride, barium chloride, strontium nitrate, chromium chloride, manganese sulfate, zinc chloride, cobalt chloride, nickel nitrate, and lead sulfate was dissolved in a 2/8 mixed solvent of ethanol and water to prepare a 1% impregnating solution. The CMC-containing sheet as prepared in Example 1was impregnated with a 1.7 times the sheet weight of the impregnating solution.

Each of the resulting water-disintegratable cleaning sheets was evaluated in the same manner as in Example 1, and the results obtained are shown in Table 2 below.

COMPARATIVE EXAMPLE 2

A cleaning sheet was produced in the same manner as in Example 2, except for replacing the metallic salt as used in Example 2 with potassium chloride, copper sulfate, ferrous chloride, ferric chloride, stannous chloride, or aluminum sulfate.

Each of the resulting sheets was evaluated in the same manner as in Example 1, and the results obtained are shown in Table 2 below.

TABLE 2

| Metallic Ion in Solution | Wet Tensile Strength (g/25 mm) MD | CD | Dusting and Fuzzing | Water Disintegrability |
|---|---|---|---|---|
| Example 2 | | | | |
| $Ca^{2+}$ | 480 | 310 | o | o |
| $Sr^{2+}$ | 492 | 322 | o | o |
| $Ba^{2+}$ | 524 | 340 | o | o |
| $Mn^{2+}$ | 273 | 163 | o | o |
| $Zn^{2+}$ | 472 | 302 | o | o |
| $Co^{2+}$ | 396 | 194 | o | o |
| $Ni^{2+}$ | 440 | 276 | o | o |
| Comparative Example 2 | | | | |
| $K^{+}$ | 42 | 19 | x | o |
| $Cu^{2+}$ | 540 | 348 | o | x |
| $Fe^{2+}$ | 442 | 283 | o | x |

TABLE 2-continued

| Metallic Ion in Solution | Wet Tensile Strength (g/25 mm) MD | CD | Dusting and Fuzzing | Water Disintegrability |
|---|---|---|---|---|
| $Sn^{2+}$ | 480 | 320 | o | x |
| $Fe^{3+}$ | 686 | 390 | o | x |
| $Al^{3+}$ | 760 | 411 | o | x |

EXAMPLE 3

Calcium chloride was dissolved in a 2/8 mixed solvent of ethanol and water in a prescribed concentration, and the resulting impregnating solution was impregnated into the CMC-containing sheet as prepared in Example 1 in an amount of 1.7 times the weight of the sheet to obtain a water-disintegrable cleaning sheet containing a $Ca^{2+}$ ion at a molar ratio of ¼, ½, or 1/1 to the carboxylate ion of CMC.

Each of the resulting cleaning sheets was evaluated in the same manner as in Example 1, and the results obtained are shown in Table 3 below.

TABLE 3

| $Ca^{2+}/COO^{-}$ Molar Ratio | Wet Tensile Strength (g/25 mm) MD | CD | Dusting and Fuzzing | Water Disintegrability |
|---|---|---|---|---|
| 1/1 | 560 | 310 | o | o |
| 1/2 | 490 | 290 | o | o |
| 1/4 | 345 | 190 | o | o |

EXAMPLE 4

A web of split and deposited fibers of a conifer fluff pulp (basis weight: 30 g/m$^2$) was sprayed with 15% of a sodium salt of an acrylic acid-2-ethylhexyl acrylate copolymer (7/3 by mol), followed by drying to obtain a water-soluble binder-containing water-disintegratable sheet.

The resulting sheet was impregnated with 1.5 times the sheet weight of an aqueous cleaning agent comprising zinc sulfate, polyoxyethylene dodecyl ether ($\bar{p}=8$), propylene glycol and water at a ratio of 1/1/15/83 to obtain a water-disintegratable cleaning sheet.

The resulting cleaning sheet was evaluated in the same manner as in Example 1, and the results obtained are shown in Table 4 below.

COMPARATIVE EXAMPLE 3

The water-soluble binder-containing water-disintegratable sheet as prepared in Example 4 was impregnated with an aqueous cleaning agent comprising polyoxyethylene dodecyl ether (p=8), propylene glycol, and water at a ratio of 1/15/84 in the same manner as in Example 4.

The resulting cleaning sheet was evaluated in the same manner as in Example 1, and the results obtained are shown in Table 4 below.

TABLE 4

| Example No. | Wet Tensile Strength (g/25 mm) MD | CD | Dusting and Fuzzing | Water Disintegrability |
|---|---|---|---|---|
| Example 1 | 260 | 280 | o | o |
| Comparative Example 3 | 15 | 13 | x | o |

EXAMPLE 5

Crepe paper having a basis weight of 25 g/m$^2$ (crepe ratio: 20%) was produced from a raw material comprising 100 parts of parts of NBKP (softwood kraft pulp) and 10 part of CMC2200 using a cylindrical net-Yankee machine.

The resulting CMC-containing sheet was sprayed with 1 part of a 2% calcium chloride aqueous solution per part of the sheet and dried to obtain a water-disintegratable sheet.

The sheet was impregnated with 1.5 times the sheet weight of a cleaning agent comprising a surfactant (Softanol 70), ethanol, and water (1/20/79). The resulting cleaning sheet was evaluated in the same manner as in Example 1, and the results obtained are shown in Table 5 below.

COMPARATIVE EXAMPLE 4

The CMC-containing crepe paper as described in Example 5 was impregnated with 1.5 times the paper weight of the same cleaning agent as used in Example 5. The resulting cleaning sheet was evaluated in the same manner as in Example 1, and the results obtained are shown in Table 5 below.

TABLE 5

| Wet Tensile Strength (g/25 mm): | Example 5 | Comparative Example 4 |
|---|---|---|
| MD | 520 | 50 |
| CD | 300 | 30 |
| Dusting | o | x |
| Water Disintegrability | o | o |

EXAMPLE 6

Toilet paper-like crepe paper having a basis weight of 20 g/m$^2$ (crepe ratio: 10%) was produced from a raw material comprising 60 parts of NBKP and 40 parts of LBKP (broad-leaved tree kraft pulp) using a cylindrical net-Yankee machine.

The crepe paper was coated with 3% the paper weight of CMC2200 with a gravure coater followed by drying to obtain CMC-containing paper.

The CMC-containing paper was uniformly sprayed with 1 part of a 2% aqueous solution of zinc sulfate per part of the paper and dried to obtain water-disintegratable paper.

The resulting water-disintegratable paper was impregnated with 2.0 times the paper weight of a cleaning agent comprising a surfactant (polyoxyethylene dodecyl ether ($\bar{p}=12$)), propylene glycol, and water (2/15/83), and the properties of the impregnated paper were evaluated in the same manner as in Example 1. The results obtained are shown in Table 6 below.

COMPARATIVE EXAMPLE 5

The CMC-containing paper as prepared in Example 6 was impregnated with the same cleaning agent as used in Example 6. The impregnated paper was evaluated in the same manner as in Example 1, and the results obtained are shown in Table 6 below.

EXAMPLE 7

The crepe paper as described in Example 6 was coated with 3% the paper weight of a 3:1 mixture of CMC2200 and calcium chloride with a gravure coater and dried to obtain water-disintegratable paper.

The water-disintegratable paper was impregnated with 2.0 times the paper weight of the same cleaning agent as used in Example 6. The impregnated paper was evaluated in the same manner as in Example 1, and the results are shown in Table 6 below.

TABLE 6

| Wet Tensile Strength (g/25 mm): | Example 6 | Example 7 | Comparative Example 5 |
|---|---|---|---|
| MD | 480 | 420 | 55 |
| CD | 350 | 300 | 40 |
| Dusting | o | o | x |
| Water Disintegrability | o | o | o |

EXAMPLE 8

A web of split and deposited fibers of conifer fluff pulp (basis weight: 40 g/m$^2$) was sprayed with 15% the weight of a 3:2 mixture of CMC1330 (produced by Daisel K.K.) and calcium chloride and dried to obtain water-disintegratable paper.

The water-disintegratable paper was impregnated with 3 times the paper weight of a cleaning agent comprising polyethylene dodecyl ether ($\bar{p}=10$), ethylene glycol and water (1/19/80), and the properties of the impregnated paper were evaluated in the same manner as in Example 1. The results obtained are shown in Table 7 below.

COMPARATIVE EXAMPLE 6

The web as described in Example 8 was sprayed with 10% the web weight of CMC1330 and dried. The resulting CMC-containing paper was impregnated with a cleaning agent in the same manner as in Example 8. The properties of the impregnated paper are shown in Table 7.

TABLE 7

| Wet Tensile Strength (g/25 mm): | Example 8 | Comparative Example 6 |
|---|---|---|
| MD | 320 | 18 |
| CD | 310 | 20 |
| Dusting | o | x |
| Water Disintegrability | o | o |

EXAMPLE 9

The crepe paper as described in Example 6 was coated with 3% the paper weight of a monoethanolamine salt of a methacrylic acid-lauryl methacrylate copolymer (7/3 by mol) with a gravure coater and dried to obtain water-soluble binder-containing paper.

The paper was uniformly sprayed with 1 part of a 2% calcium chloride aqueous solution per part of the paper and dried to obtain water-disintegratable paper.

The water-disintegratable paper was impregnated with 1.5 times the paper weight of a cleaning agent comprising a surfactant (dodecyldimethylamine oxide), polyethylene glycol 400 and water (1/20/79). Properties of the impregnated paper were evaluated in the same manner as in Example 1, and the results obtained are shown in Table 8 below.

COMPARATIVE EXAMPLE 7

The water-soluble binder-containing paper as obtained in Example 9 was impregnated with a cleaning agent in the same manner as in Example 9. Properties of the impregnated paper are shown in Table 8 below.

TABLE 8

| Wet Tensile Strength (g/25 mm): | Example 9 | Comparative Example 7 |
|---|---|---|
| MD | 450 | 48 |
| CD | 310 | 40 |
| Dusting | o | x |
| Water Disintegrability | o | o |

EXAMPLE 10

Water-disintegratable crepe paper having a basis weight of 25 g/m$^2$ (crepe ratio: 15%) was produced from a raw material comprising 100 parts of NBKP and 10 parts of a water-soluble carboxymethyl cellulose sodium-calcium mixed salt (Na:Ca=1/1 by mol; produced by Daisel K.K.) using a cylindrical net-Yankee machine.

The water-disintegratable paper was impregnated with 1.7 times the paper weight of a cleaning agent comprising a surfactant (Softanol 90), ethanol and water (1/15/84), and the impregnated paper was evaluated in the same manner as in Example 1. The results obtained are shown in Table 9 below.

COMPARATIVE EXAMPLE 8

Water-disintegratable crepe paper having a basis weight of 25 g/m$^2$ (crepe ratio: 15%) was produced from a raw material comprising 100 parts of NBKP and 10 parts of a water-soluble sodium carboxymethyl cellulose (produced by Daisel K.K.) using a cylindrical net-Yankee machine.

The water-disintegratable paper was impregnated with a cleaning agent in the same manner as in Example 10. Properties of the impregnated paper are shown in Table 9.

TABLE 9

| Wet Tensile Strength (g/25 mm): | Example 10 | Comparative Example 8 |
|---|---|---|
| MD | 300 | 45 |
| CD | 250 | 25 |
| Dusting | o | x |
| Water Disintegrability | o | o |

EXAMPLE 11

Toilet paper-like crepe paper having a basis weight of 20 g/m$^2$ (crepe ratio: 10%) was produced from a raw material comprising 70 parts of NBKP and 30 parts of LBKP using a cylindrical net-Yankee machine.

The crepe paper was coated with 3% the paper weight of a water-soluble carboxymethyl cellulose sodium-zinc mixed salt (Na:Zn=10/1 by mol; produced by Daisel K.K.) and dried to obtain water-disintegratable paper.

The water-disintegratable paper was impregnated with 2.0 times the paper weight of a cleaning agent comprising a surfactant (polyoxyethylene dodecyl ether ($\bar{p}$=12)), propylene glycol and water (2/15/83). The impregnated paper was evaluated in the same manner as in Example 1, and the results obtained are shown in Table 10 below.

COMPARATIVE EXAMPLE 9

The crepe paper as described in Example 11 was coated with 3% the paper weight of a water-soluble sodium corboxymethyl cellulose with a gravure coater and dried to obtain water-disintegratable paper.

The water-disintegratable paper was impregnated with a cleaning agent in the same manner as in Example 11. Properties of the impregnated paper are shown in Table 10.

EXAMPLE 12

The crepe paper as described in Example 11 was coated with 3% the paper weight of a water-soluble carboxymethyl cellulose sodium-calcium mixed salt (Na:Ca=10/1 by mol; produced by Daisel K.K.) and dried to obtain water-disintegratable paper.

The water-disintegratable paper was impregnated with 2.0 times the paper weight of a cleaning agent comprising surfactant, propylene glycol and water. The impregnated paper was evaluated in the same manner as in Example 1, and the results obtained are shown in Table 10 below.

TABLE 10

| Wet Tensile Strength (g/25 mm): | Example 11 | Example 12 | Comparative Example 9 |
|---|---|---|---|
| MD | 320 | 470 | 40 |
| CD | 250 | 350 | 20 |
| Dusting | o | o | x |
| Water Disintegrability | o | o | o |

EXAMPLE 13

A web of split and deposited fibers of conifer fluff pulp having a basis weight of 40 g/m$^2$ was sprayed with 10% the web weight of a water-soluble carboxymethyl cellulose sodium-calcium mixed salt (Na:Ca=1/1 by mole) and dried to obtain water-disintegratable paper.

The water-disintegratable paper was impregnated with 3 times the paper weight of a cleaning agent comprising a surfactant (polyethylene dodecyl ether ($\bar{p}$=10)), ethylene glycol and water (1/19/80). The impregnated paper was evaluated in the same manner as in Example 1, and the results obtained are shown in Table 11 below.

COMPARATIVE EXAMPLE 10

The web as described in Example 13 was sprayed with 10% the web weight of a water-soluble sodium carboxymethyl cellulose and dried to obtain water-disintegratable paper.

The water-disintegratable paper was impregnated with a cleaning agent in the same manner as in Example 13. Properties of the impregnated paper are shown in Table 11.

TABLE 11

| Wet Tensile Strength (g/25 mm): | Example 13 | Comparative Example 10 |
|---|---|---|
| MD | 310 | 10 |
| CD | 280 | 15 |
| Dusting | o | x |
| Water Disintegrability | o | o |

EXAMPLE 14

The crepe paper as described in Example 11 was coated with 3% the paper weight of a water-soluble methacrylic acid-lauryl methacrylate copolymer (7/3 by mol) potassium-calcium mixed salt (K:Ca=1/1 by mole) with a gravure coater and dried to obtain water-disintegratable paper.

The water-disintegratable paper was impregnated with 1.5 times the paper weight of a cleaning agent comprising a surfactant (dodecyldimethylamine oxide), polyethylene glycol 400 and water (1/19/80), .and the impregnated paper was evaluated in the same manner as in Example 1. The results obtained are shown in Table 12 below.

COMPARATIVE EXAMPLE 11

The crepe paper as described in Example 11 was coated with 3% of a methacrylic acid-lauryl methacrylate copolymer (7/3 by mol) sodium salt and dried to obtain water-soluble binder-containing paper.

The water-soluble binder-containing paper was impregnated with a cleaning agent in the same manner as in Example 14. Properties of the impregnated paper are shown in Table 12 below.

TABLE 12

| Wet Tensile Strength (g/25 mm): | Example 14 | Comparative Example 11 |
|---|---|---|
| MD | 410 | 36 |
| CD | 280 | 25 |
| Dusting | o | x |
| Water Disintegrability | o | o |

EXAMPLE 15

A water-disintegratable paper sheet having a basis weight of 25 g/m$^2$ was produced from a bleached kraft pulp of conifer beaten to a CSF (Canadian Standard Freeness) of 680 cc using an ordinary paper machine.

The water-disintegratable paper sheet was sprayed with 3% the paper weight (corresponding to 0.75 g/m$^2$) of a sodium carboxymethyl cellulose "CMC 1330" (produced by Daisel Kagaku K.K.) in the form of a 1% aqueous solution and dried to obtain a CMC-containing sheet.

Separately, the water-disintegratable paper sheet was sprayed with 3% the paper weight (corresponding to 0.75 g/m$^2$) of a sodium polyacrylate having a mean molecular weight of 135,000 (produced by Aldrich Chemical Company, Inc.) in the form of a 1% aqueous solution and dried to obtain a polyacrylate-containing sheet.

The CMC-containing sheet and the polyacrylate-containing sheet were impregnated with 1.7 times the sheet weight of a cleaning agent comprising calcium chloride, polyoxyethylene dodocylether ($\bar{p}=8$), ethanol and water (1/1/20/78) to obtain a water-disintegratable cleaning sheet.

Wet tensile strength, dusting and fuzzing on use, and water disintegrability of the resulting cleaning sheet were evaluated in accordance with the following test methods. The results obtained are shown in Table 13 below.

1. Wet Tensile Strength:

The same as in Example 1.

2. Dusting and Fuzzinc:

The same as in Example 1.

3. Water Disintegratability:

In 1 l-volume beaker was put 500 ml of tap water and a Teflon coated stirrer bar, and agitated by means of a magnetic stirrer at 300 rpm.

The cleaning sheet was cut to pieces of 50 mm ×50 mm and put into the water under stirring. The time required for collapse (water disintegration) of the sheet in water was measured.

COMPARATIVE EXAMPLE 12

The water-disintegratable paper sheet as described in Example 15 was sprayed with 3% the paper weight (corresponding to 0.75 g/m$^2$) of carrageenan having a mean molecular weight of 300,000 (produced by Tokyo Kasei K.K.) in the form of a 1% aqueous solution and dried to obtain a carrageenan-containing sheet.

The carrageenan-containing sheet was impregnated with a cleaning agent in the same manner as in Example 15. Properties of the impregnated paper are shown in Table 13 below.

TABLE 13

| | Wet Tensile Strength (g/25 mm) | | Dusting and Fuzzing | Water Disintegrability (sec.) |
|---|---|---|---|---|
| | MD | CD | | |
| Example 15 | | | | |
| CMC-containing Sheet | 430 | 270 | o | 14 |
| Polyacrylic acid-containing Sheet | 620 | 390 | o | 45 |
| Comparative Example 12 | | | | |
| Carrageenan-containing Sheet | 78 | 46 | Δ | 17 |

While the invention has been described in detail and with reference to specific embodiments thereof, it will be apparent to one skilled in the art that various changes and modifications can be made therein without departing from the spirit and scope thereof.

What is claimed is:

1. A water-disintegratable cleaning sheet comprising a web of water-dispersible fibers selected from the group consisting of wood pulp fibers, non-wood vegetable fibers, rayon fibers, and polyester fibers, having incorporated thereinto a water-soluble binder having a carboxyl group that is selected from the group consisting of carboxyl group containing polysaccharide derivatives, synthetic polymers of unsaturated carboxylic acid monomers, and alginic acid in an amount from 0.1 to 30% by weight based on the dry wight of said web; at least one metallic ion selected from the group consisting of ions of alkaline earth metals, manganese, zinc, cobalt, and nickel, in an amount of at least ¼ mol per mol of the carboxyl group of said water-soluble binder; and an aqueous cleaning agent containing an organic solvent which comprises an organic solvent in an amount ranging from 5 to 95% by weight, and water in an amount ranging from 95 to 5% by weight.

2. The water-disintegratable cleaning sheet as claimed in claim 1, wherein said water-soluble binder is an alkali metal salt formed between the carboxyl group thereof and an alkali metal.

3. The water-disintegratable cleaning sheet as claimed in claim 1, wherein said at least one metallic ion selected from the group consisting of ions of alkaline earth metals, manganese, zinc, cobalt, and nickel, is incorporated thereinto in the forms of:

(A) an intermolecular mixed salt of said water-soluble binder formed between the carboxyl group thereof and (a) an alkali metal and (b) at least one selected from the group consisting of alkaline earth metals, manganese, zinc, cobalt and nickel; and/or (B) a water-soluble salt.

4. The water-disintegratable cleaning sheet as claimed in claim 3, wherein a molar ratio of (a) an alkali metal and (b) at least one polyvalent metal selected from the group consisting of alkaline earth metals, manganese, zinc, cobalt, and nickel, of said intermolecular mixed salt (A) is in the ranges from 1/0.01 to 1/10.

5. The water-disintegratable cleaning sheet as claimed in claim 3, wherein said water-soluble salt is at least one selected from the group consisting of a hydroxide, a chloride, a sulfate, a nitrate, a carbonate, a formate and an acetate, of at lease one selected from the group consisting of alkaline earth metals, manganese, zinc, cobalt, and nickel.

6. The water-disintegratable cleaning sheet as claimed in claim 1, wherein said water-soluble binder is a carboxymethyl cellulose.

7. The water-disintegratable cleaning sheet as claimed in claim 1, wherein said water-soluble binder is a polymer of an unsaturated carboxylic acid, a copolymer of two or more of an unsaturated carboxylic acid, or a copolymer of an unsaturated carboxylic acid and other copolymerizable monomer.

8. The water-disintegratable cleaning sheet as claimed in claim 7, wherein said unsaturated carboxylic acid is acrylic acid or methacrylic acid.

9. The water-disintegratable cleaning sheet as claimed in claim 1, wherein said organic solvent contained in said aqueous cleaning agent is a water compatible solvent.

10. The water-disintegratable cleaning sheet as claimed in claim 1, wherein said organic solvent contained in said aqueous cleaning agent is methanol, ethanol, propanol, ethylene glycol, polyethylene glycol or propylene glycol.

11. The water-disintegratable cleaning sheet as claimed in claim 1, wherein said water-soluble binder having a carboxyl group is selected from the group consisting of carboxymethyl cellulose, carboxyethyl cellulose; polyacrylic acid, polymethacrylic acid, acrylic acid-methacrylic acid copolymer, acrylic acid-alkyl acrylate copolymer, acrylic acid-alkylmethacrylate copolymer, methacrylic acid-alkylacrylate copolymer, and methacrylic acid-alkylmethacrylate copolymer.

12. The water-disintegratable cleaning sheet as claimed in claim 1, wherein said aqueous cleaning agent is present in an amount of 0.5 to 5 times of the total weight of the web, the water-soluble binder and the metallic ion.

13. The water-disintegratable cleaning sheet as claimed in claim 1, wherein said aqueous cleaning agent comprises from 5 to 95% by weight of a water compatible organic solvent and from 95 to 5% by weight of water.

* * * * *